US009137857B2

(12) United States Patent
Feng et al.

(10) Patent No.: US 9,137,857 B2
(45) Date of Patent: Sep. 15, 2015

(54) METHOD FOR MAKING HEATER

(71) Applicants: Tsinghua University, Beijing (CN); HON HAI PRECISION INDUSTRY CO., LTD., New Taipei (TW)

(72) Inventors: Chen Feng, Beijing (CN); Xue-Wei Guo, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 102 days.

(21) Appl. No.: 13/869,206

(22) Filed: Apr. 24, 2013

(65) Prior Publication Data

US 2014/0103009 A1 Apr. 17, 2014

(30) Foreign Application Priority Data

Oct. 12, 2012 (CN) ..... 2012 1 03858903

(51) Int. Cl.
*H05B 3/00* (2006.01)
*H05B 3/14* (2006.01)
*H05B 3/34* (2006.01)

(52) U.S. Cl.
CPC ..... *H05B 3/145* (2013.01); *H05B 3/34* (2013.01); *H05B 2203/011* (2013.01); *H05B 2203/013* (2013.01); *H05B 2203/017* (2013.01); *H05B 2214/04* (2013.01)

(58) Field of Classification Search
CPC .... B82Y 30/00; B82Y 40/00; Y10S 977/742; Y10S 977/842; Y10S 977/89; B01J 21/185; H01C 17/006; H05B 2203/017
USPC ..... 29/611, 610.1, 613, 619, 874; 156/242, 156/263, 272.8, 502, 504, 516, 517
See application file for complete search history.

(56) References Cited

U.S. PATENT DOCUMENTS

| | | | | |
|---|---|---|---|---|
| 8,162,643 | B2 * | 4/2012 | Lemaire et al. | 425/66 |
| 8,365,793 | B2 * | 2/2013 | Fan et al. | 156/516 |
| 2011/0155713 | A1 | 6/2011 | Wang et al. | |
| 2011/0233816 | A1 | 9/2011 | Liu | |
| 2013/0284345 | A1 | 10/2013 | Feng et al. | |

FOREIGN PATENT DOCUMENTS

| | | |
|---|---|---|
| CN | 101844757 | 9/2010 |
| CN | 102111926 | 6/2011 |
| CN | 103379680 | 10/2013 |

* cited by examiner

*Primary Examiner* — Thiem Phan
(74) *Attorney, Agent, or Firm* — Novak Druce Connolly Bove + Quigg LLP

(57) ABSTRACT

A method for making a heater is provided. A support and a flexible substrate are provided. The flexible substrate is stretched along a first direction and is fixed on a surface of the support. An adhesive layer is coated on a surface of the flexible substrate. One end of a carbon nanotube film is attached on the flexible substrate via the adhesive layer. The carbon nanotube film is wrapped around the support by whirling the support to form a carbon nanotube structure. The flexible substrate is separated from the support and shrinks along the first direction. At least two electrodes are electrically connected with the carbon nanotube structure. A voltage is applied between the at least two electrodes to heat the carbon nanotube structure. The carbon nanotube structure heats and solidifies the adhesive layer.

18 Claims, 6 Drawing Sheets

METHOD FOR MAKING HEATER

RELATED APPLICATIONS

This application claims all benefits accruing under 35 U.S.C. §119 from China Patent Application No. 201210385890.3, Oct. 12, 2012, in the China Intellectual Property Office, the disclosure of which is incorporated herein by reference.

BACKGROUND

1. Technical Field

The present disclosure relates to a method for making a heater.

2. Description of Related Art

Heaters generate heat. Heaters can be divided into three types: linear heater, planar heater, and hollow heater.

A typical heater includes a heating element and at least two electrodes. The heating element is electrically connected with the two electrodes. The heating element generates heat when a voltage is applied to it. The heating element is often made of a metal such as tungsten. Metals have good conductivity and generate a lot of heat even when a low voltage is applied. However, metals can easily oxidize, thus the heater element has a short life. Furthermore, because metals have a relative high density, the heating element made of metals are heavy, which limits applications of such heater.

Therefore there is room for improvement in the art.

BRIEF DESCRIPTION OF THE DRAWING

Many aspects of the present disclosure can be better understood with reference to the following drawings. The components in the drawings are not necessarily to scale, the emphasis instead being placed upon clearly illustrating the principles of the present embodiments.

DETAILED DESCRIPTION

The disclosure is illustrated by way of example and not by way of limitation in the figures of the accompanying drawings in which like references indicate similar elements. It should be noted that references to "another," "an," or "one" embodiment in this disclosure are not necessarily to the same embodiment, and such references mean at least one.

Figure 1:
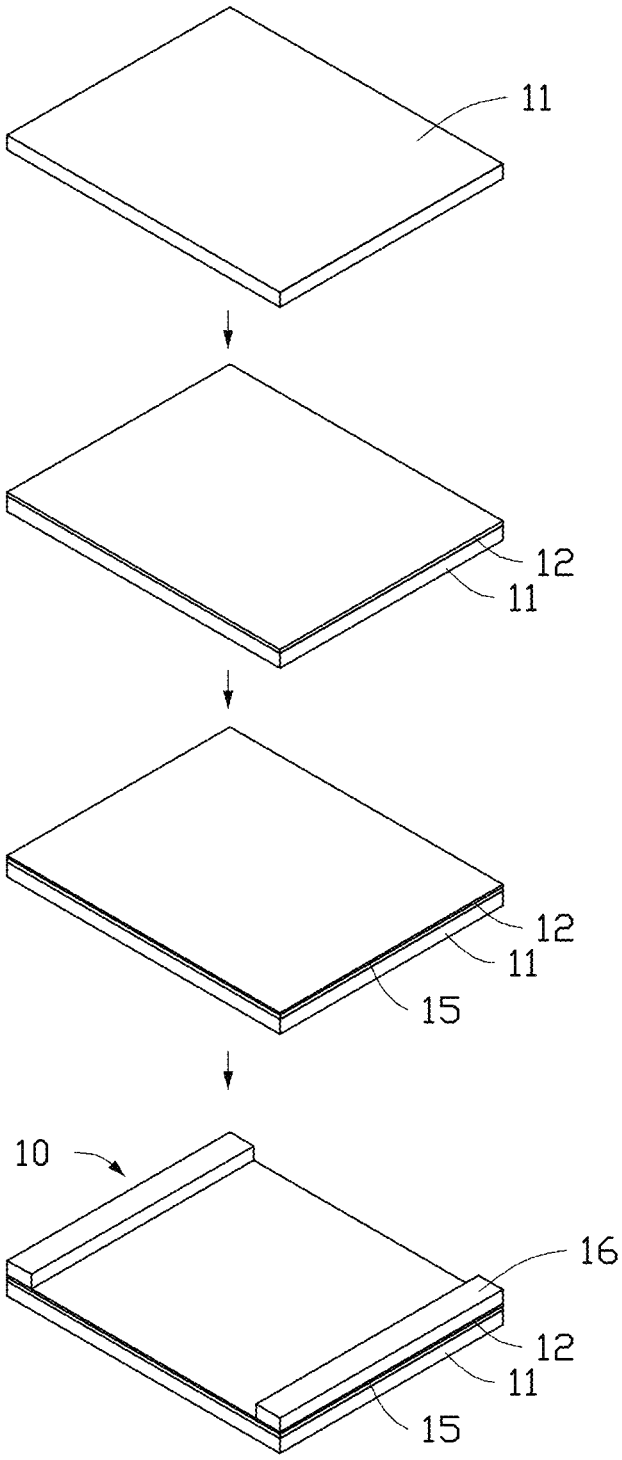
FIG. 1 is a schematic view showing one embodiment of a process of making a heater.

Referring to FIG. 1, an embodiment of a method for making a heater 10 is provided. The method includes the steps of:

S1: providing a substrate 11 having a surface;

S2: coating an adhesive layer 12 on the surface of substrate 11;

S3: drawing a carbon nanotube structure 15 from a carbon nanotube array, and attaching the carbon nanotube structure 15 on the adhesive layer 12;

S4: forming at least two electrodes 16 on a surface of the carbon nanotube structure 15;

S5: applying a voltage between the at least two electrodes 16 to heat the carbon nanotube structure 15, wherein the carbon nanotube structure 15 heats and solidifies the adhesive layer 12.

In step S1, a material of the substrate 11 is electrically insulated, and can be a flexible polymer or flexible plastic, such as silicon rubber, PTEF (polytetrafluoroethylene), PU (polyurethane), and PVC (polyvinyl chloride). The material of the substrate 11 can also be rigid, such as glass and quartz. In one embodiment, the substrate 11 is a rectangular PET (polyethylene terephthalate).

In the step S2, a material of the adhesive layer 12 can be a resin adhesive or a rubber adhesive. The resin adhesive can be epoxy resin, PU resin or acrylate. The rubber adhesive can be chloroprene rubber or silica gel. In the embodiment according to FIG. 1, the material of the adhesive layer 12 is silica gel.

Figure 2:
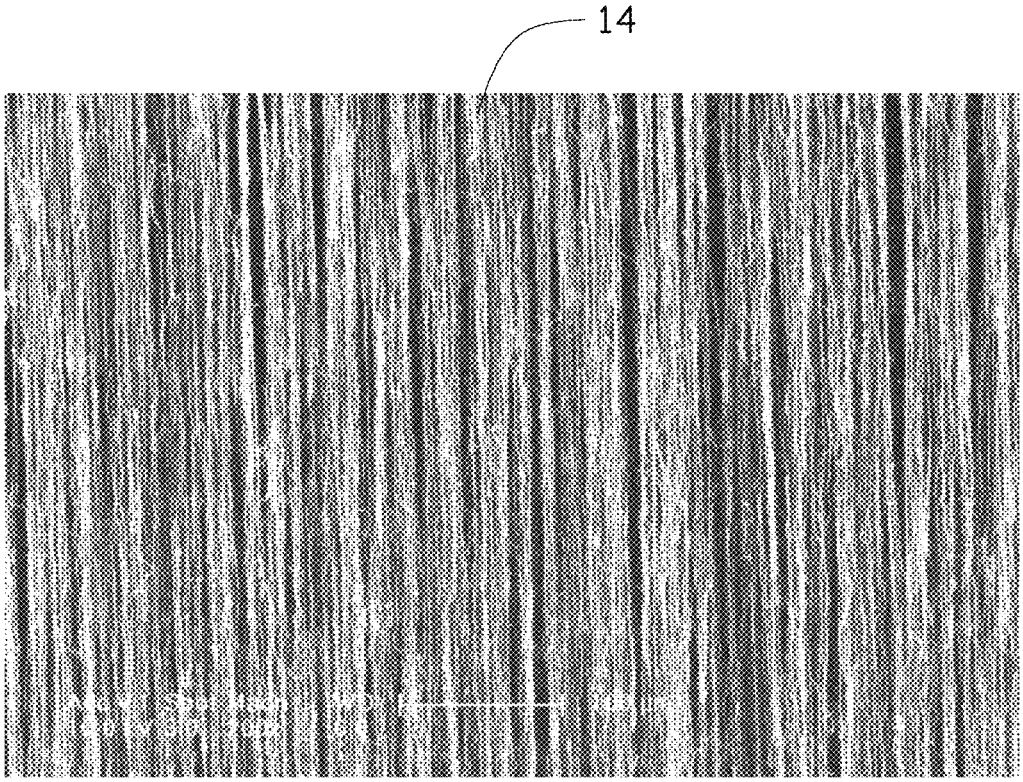
FIG. 2 is a scanning electron microscope (SEM) photo of a carbon nanotube film.

In the step S3, the carbon nanotube structure 15 includes at least one carbon nanotube film. FIG. 2 shows that the carbon nanotube film 14 includes a plurality of carbon nanotubes joined end to end. The plurality of carbon nanotubes are joined end to end means that the end of the one carbon nanotube is linearly connected with the end of another carbon nanotube. The plurality of carbon nanotubes is substantially parallel with each other. The plurality of carbon nanotubes in the carbon nanotube film 14 is substantially parallel with a surface of the carbon nanotube film. The plurality of carbon nanotubes in the carbon nanotube film are joined with each other by van der Waals attractive force. The plurality of carbon nanotubes in the carbon nanotube can be pure, meaning there is no impurity attached on each carbon nanotube. The carbon nanotube film can consist of the plurality of carbon nanotubes. The carbon nanotube film 14 is a free-standing structure, that is, the carbon nanotube film 14 can be suspended in air with two ends of the carbon nanotube film fixed without any support therebetween and still maintain its structural integrity. In the embodiment according to FIG. 1, the carbon nanotube structure 15 is one carbon nanotube film 14 consisting of a plurality of carbon nanotubes. The carbon nanotube structure 15 covers the adhesive layer 12, and the plurality of carbon nanotubes in the carbon nanotube structure 15 contact with the adhesive layer 12.

In step S3, the at least two electrodes 16 can be formed on the surface of the carbon nanotube structure 15 by a coating method, sprinting method, sputtering method, or electroplating method. The at least two electrodes 16 can also be fixed on the surface of the carbon nanotube structure 15 via conductive adhesive. In the embodiment according to FIG. 1, the at least two electrodes 16 are formed on the surface of the carbon nanotube structure 15 by sputtering method.

In the step S4, the carbon nanotube structure 15 can generate Joule heat under the voltage between the at least two electrodes 16. Because the carbon nanotube structure 15 is attached on the adhesive layer 12, the adhesive layer 12 is heated and solidified by the carbon nanotube structure 15. Because the carbon nanotube structure 15 contacts the adhesive layer 12 directly, the adhesive layer 12 can be uniformly heated by the carbon nanotube structure 15.

Alternatively, after step S3, another adhesive layer can be formed on a surface of the carbon nanotube structure 15, such that the carbon nanotube structure 15 is located between the two adhesive layers. Then the carbon nanotube structure 15 can heat and solidify the two adhesive layers.

Figure 3:
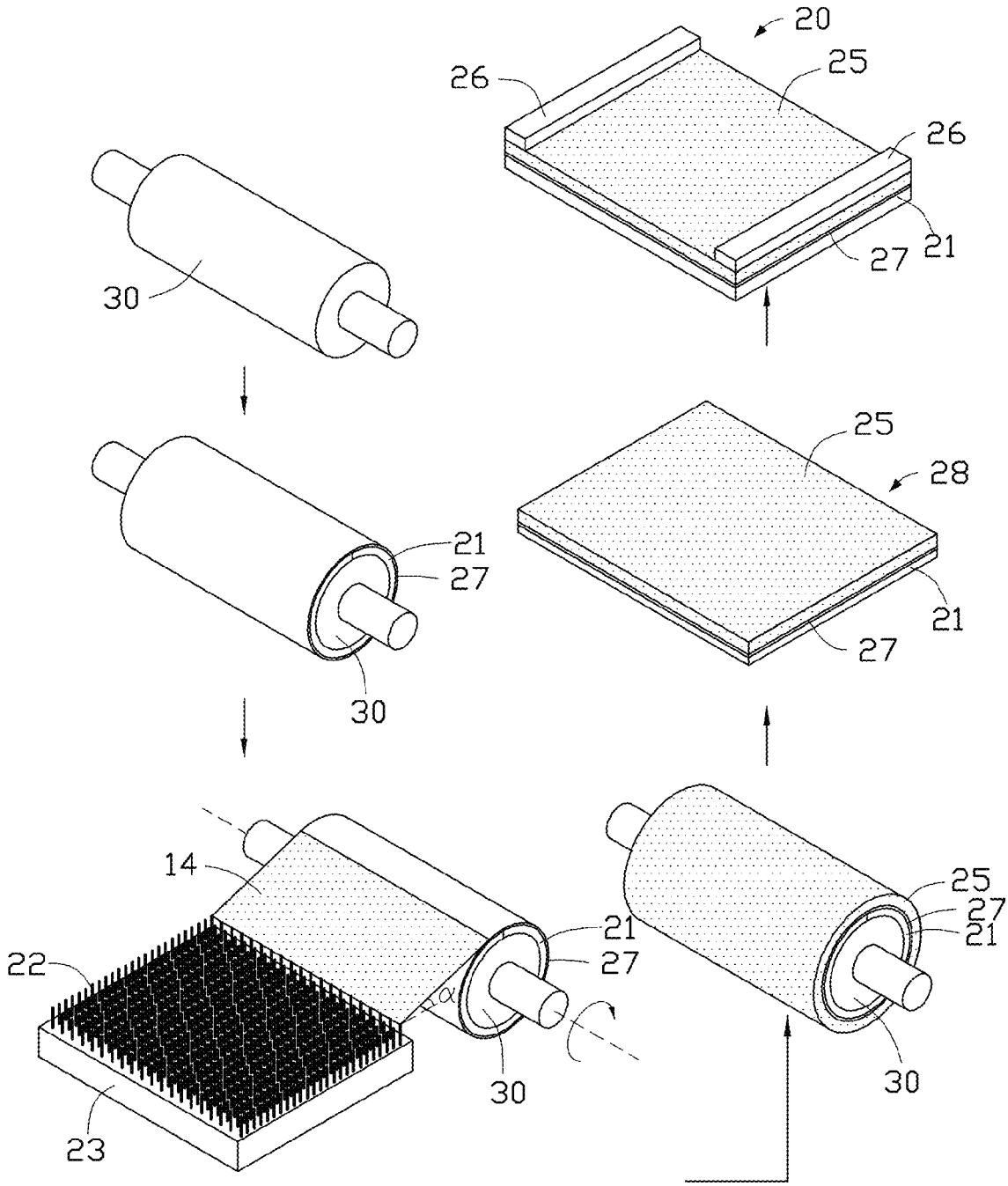
FIG. 3 is a schematic view showing another embodiment of a process of making a heater.

Referring to FIG. 3, a method for making a heater 20 according to another embodiment is provided. The method includes the steps of:

N1: providing a support 30 and stretching a flexible substrate 21 along a first direction and fixing the flexible substrate 21 on a surface of the support 30;

N2: coating an adhesive layer 27 on a surface of the flexible substrate 21;

N3: drawing a carbon nanotube film 14 from a carbon nanotube array 22, and attaching one end of the carbon nanotube film 14 on the flexible substrate 21 via the adhesive layer 27;

N4: wrapping the carbon nanotube film 14 around the support 30 by rotating the support 30 to form a carbon nanotube structure 25 around the flexible substrate 21 and the adhesive layer 27;

N5: separating the flexible substrate 21 from the support 30, wherein the flexible substrate 21 shrinks along the first direction, and the carbon nanotube structure 25 includes a plurality of carbon nanotubes aligned in the first direction;

N6: electrically connecting at least two electrodes 26 on a surface of the carbon nanotube structure 25; and N7: applying a voltage between the at least two electrodes 26 to heat the carbon nanotube structure 25, wherein the carbon nanotube structure 25 heats and solidifies the adhesive layer 27.

In step N1, the support 30 can have a column structure, a triangular prism structure, or a cuboid structure. In one embodiment according to FIG. 3, the support 30 has a column structure. The support 30 can rotate around its axis, driven by an electric motor. A material of the flexible substrate 21 is electrically insulated, and can be a flexible polymer or flexible plastic, such as silicon rubber, PTEF, PU, and PVC. In one embodiment, the flexible substrate 21 is a rectangular PU, a length of the flexible substrate 21 is about 40 centimeters, and a width of the flexible substrate 21 is about 30 centimeters.

In one embodiment, the step S1 includes sub-steps of:

N11: stretching the flexible substrate 21;

N12: fixing one end of the flexible substrate 21 on the surface of the support 30; and N13: rotating the support 30 to wrap the flexible substrate 21 around the circumferential surface of the support 30.

In step N11, the flexible substrate 21 includes a first side and a second side. After being stretched, the length of the first side of the flexible substrate 21 is increased about 10% under the stretching force. In the embodiment disclosed above, the length of the first side of the flexible substrate 21 after stretching is about 44 centimeters. In step N2, the second side is attached on the circumferential surface of the support 30, and the flexible substrate 21 is wrapped around the support 30.

In step N2, after the flexible substrate 21 is wrapped on the support 30, the adhesive layer 27 can be formed on the circumferential surface of the flexible substrate 21. In one embodiment, a material of the adhesive layer 17 can be silica gel.

In step N3, the step includes sub-steps of:

N31: providing a carbon nanotube array 22 formed on a grown substrate 23;

N32: pulling out a carbon nanotube film 14 from the carbon nanotube array 22; and N33: attaching one end of the carbon nanotube film 14 on the flexible substrate 21, and the carbon nanotube film 14 is kept stretched between the carbon nanotube array 22 and the flexible substrate 21.

In step N31, the carbon nanotube array 22 includes carbon nanotubes aligned in a same direction. The aligned direction of the carbon nanotubes in the carbon nanotube array is substantially perpendicular to the top surface of the grown substrate 23.

In step N32, the carbon nanotube film 14 can be pulled out by the steps of:

N321: selecting some carbon nanotubes having a predetermined width from the array of carbon nanotubes; and N322: pulling the carbon nanotubes to obtain nanotube segments at uniform speed to achieve the carbon nanotube film 14.

In step N321, the carbon nanotubes are substantially parallel to each other. The carbon nanotubes can be selected by using an adhesive tape as the tool to contact the carbon nanotubes. In step N322, the pulling direction is substantially perpendicular to the growing direction of the super-aligned array of carbon nanotubes. The carbon nanotube film 14 can be pulled out continuously from the carbon nanotube array 22. The carbon nanotube film includes a plurality of carbon nanotubes joined end to end. The plurality of carbon nanotubes are joined end to end, which means that the end of the one carbon nanotube is linearly connected with the end of another carbon nanotube. The plurality of carbon nanotubes are substantially parallel with each other. The plurality of carbon nanotubes in the carbon nanotube film 14 are substantially parallel with a surface of the carbon nanotube film 14. The plurality of carbon nanotubes in the carbon nanotube film 14 are joined with each other by van der Waals attractive force. The plurality of carbon nanotubes in the carbon nanotube 14 can be pure, meaning there is no impurity attached on each carbon nanotube. The carbon nanotube film can consist of the plurality of carbon nanotubes. The carbon nanotube film is a free-standing structure, that is, the carbon nanotube film can be suspended in the air with two ends of the carbon nanotube film 14 fixed without any support between and still maintain its structural integrity.

In step N322, during the pulling process, as the initial carbon nanotubes are drawn out, other carbon nanotubes are also drawn out end to end due to van der Waals attractive force between ends of adjacent segments. This process of pulling produces a substantially continuous and uniform carbon nanotube film having a predetermined width. The width of the carbon nanotube film depends on a size of the carbon nanotube array. The length of the carbon nanotube film can be set as desired. In one embodiment, when the substrate is a 4 inch type wafer, a width of the carbon nanotube film can be in an approximate range from 1 centimeter (cm) to 10 cm, the length of the carbon nanotube film can reach about 120 m, and the thickness of the carbon nanotube film can be in an approximate range from 0.5 nm to 100 microns.

In step N33, the carbon nanotube film 14 is suspended between the carbon nanotube array 22 and the flexible substrate 21. The carbon nanotube film 14 is attached on the flexible substrate 21 via the adhesive layer 27. One part of the carbon nanotube film 14 is suspended between the carbon nanotube array 22 and the support 30. The carbon nanotubes in the part of the carbon nanotube film 14 that is suspended between the carbon nanotube array and the support 30 are oriented in substantially the same direction perpendicular with an axis of the support 30.

In step N3, after the end of carbon nanotube film 14 is attached on the flexible substrate 21, an angle can be defined by the surface of the carbon nanotube film 14 and the aligned direction of the carbon nanotubes in the carbon nanotube array 22. The angle can be in a range from about 60 degrees to about 90 degrees. In one embodiment, the angle is about 97 degrees.

In step N4, the support 30 rotates around its axis, and the carbon nanotube film 14 is pulled out continuously from the carbon nanotube array 22 and wraps around the support 30. A rotating speed of the support 30 is less than 15 m/s. In one embodiment, the rotating speed is about 0.5 m/s. The carbon nanotube structure 25 can be formed by winding the carbon nanotube film 14 continuously around the flexible substrate 21. Thus, a plurality of layers of carbon nanotube film 14 can be formed. The carbon nanotube structure 25 includes the plurality of layers of carbon nanotube films 14 joined with each other by van der Waals attractive force. The layers of the carbon nanotube films 14 can be adjusted by changing the rotating rounds of the support 30. In one embodiment, the carbon nanotube structure 25 includes 200 layers of carbon nanotube films 14. The carbon nanotube structure 25 is fixed on the flexible substrate 21 via the adhesive layer 27. A pressing force can be applied on the carbon nanotube structure 25 to make the adhesive layer 27 be filled into the carbon nanotube structure 25, and the carbon nanotube structure 25 can combine tightly with the adhesive layer 27. In one embodiment, the pressing force is applied by a soft brush (not show). The soft brush can brush the carbon nanotube structure 25 as the support 30 rotates.

In step N5, the flexible substrate 21 with the carbon nanotube structure 25 is separated from the support 30. The flexible substrate 21, the adhesive layer 27 and the carbon nanotube structure 25 are wrapped around the support 30 before they are separated from the support 30. The flexible substrate 21, the adhesive layer 27 and the carbon nanotube structure 25 are cut along a line which is substantially parallel with the axis of the support 30. Thus, the flexible substrate 21 unfolds to have a planar structure. The adhesive layer 27 is attached on the circumferential surface of the flexible substrate 21, and the carbon nanotube structure 25 is attached on the surface of the adhesive layer 27. The flexible substrate 21, the adhesive layer 27 and the carbon nanotube structure 25 can be cut by a mechanical method or by an etching method. In one embodiment, the flexible substrate 21, the adhesive layer 27 and the carbon nanotube structure 25 are cut by a laser.

Figure 4:
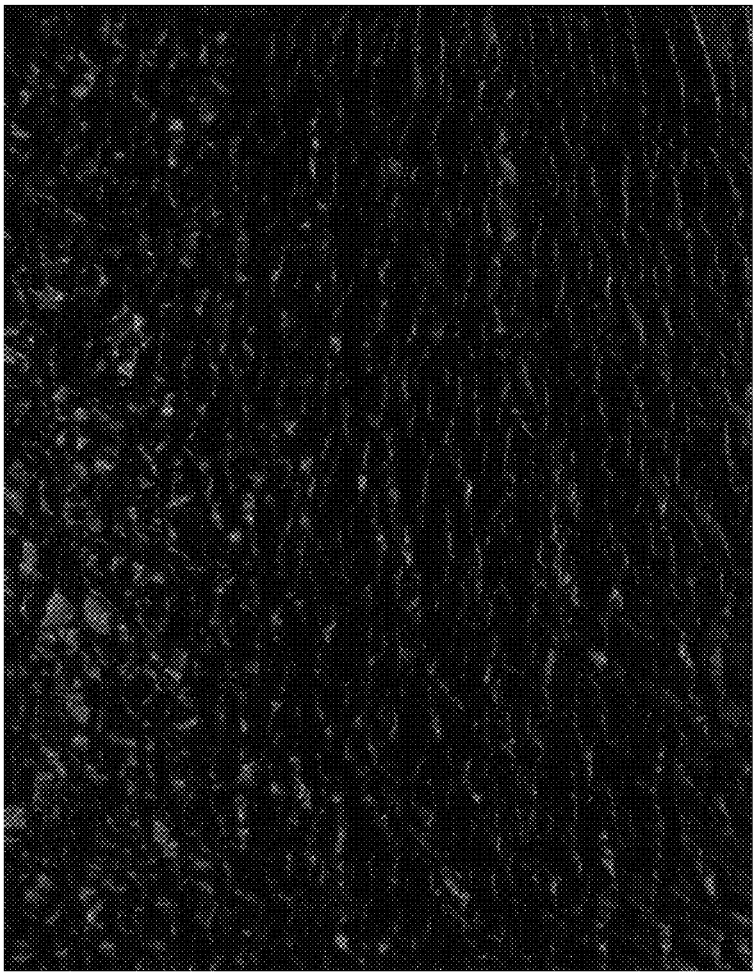
FIG. 4 is a photo of a carbon nanotube structure formed on a substrate of the heater.
Figure 5:
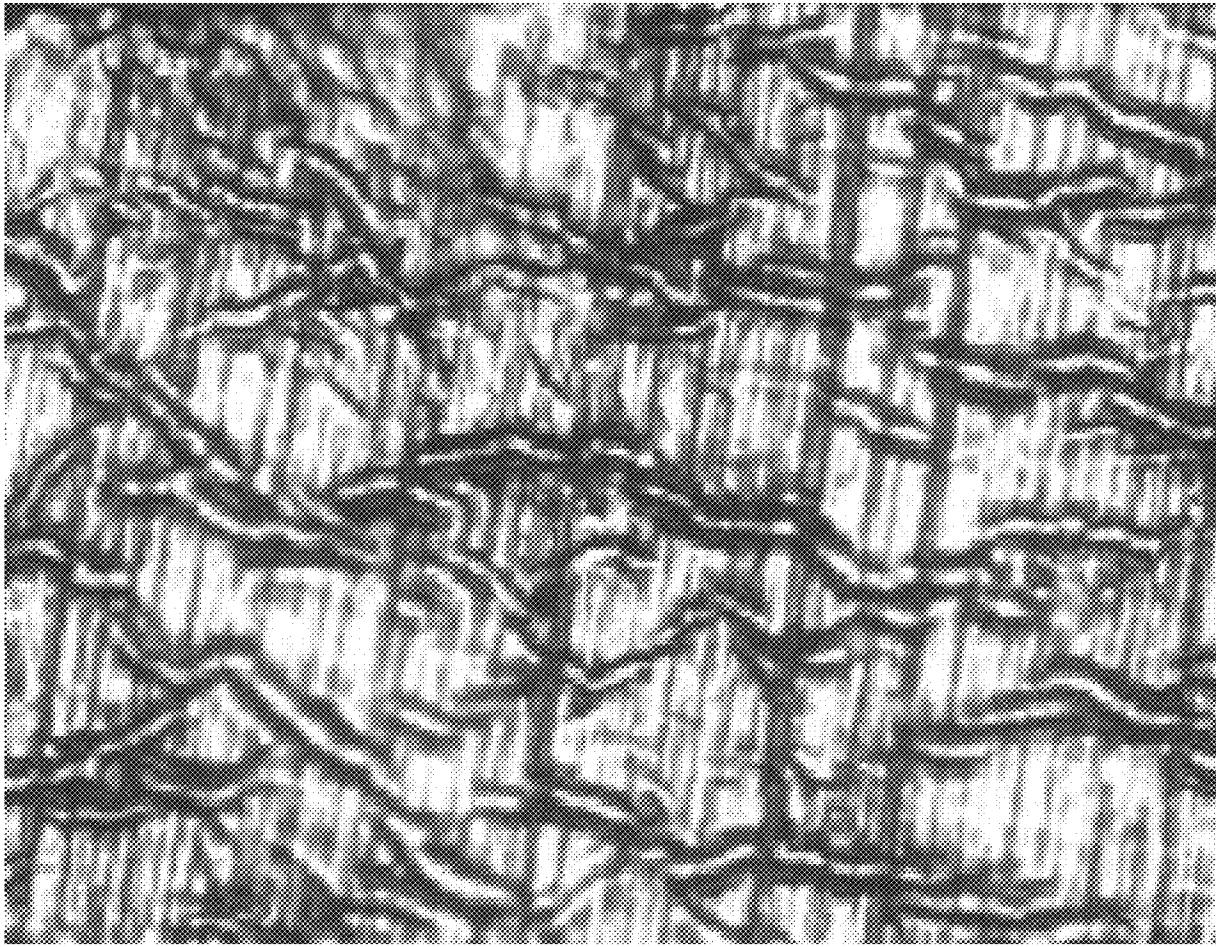
FIG. 5 is an SEM photo of the carbon nanotube structure formed on the substrate of the heater.

Before the flexible substrate 21 is attached on the support 30, the flexible substrate 21 is stretched. As such, after the flexible substrate 21 is separated from the support 30, the flexible substrate 21 shrinks along the first direction. After the flexible substrate 21 shrinks along the first direction, the carbon nanotube structure 25 also shrinks along the first direction. Thus, a plurality of wrinkles are formed in the carbon nanotube structure 25, as shown in FIGS. 4 and 5. Each of the plurality of wrinkles has a linear structure, and is oriented along a second direction. The second direction is substantially perpendicular with the first direction. The carbon nanotubes in the carbon nanotube structure 25 are oriented along the first direction. In the embodiment disclosed above, the material of the flexible substrate 21 is PU. After the flexible substrate 21 is separated from the support 20, the length of the flexible substrate 21 shrinks into its original length of about 40 centimeters.

In step N6, the at least two electrodes 26 are located on two opposite ends of the carbon nanotube structure 25. The carbon nanotube structure 25 includes a first end and a second end opposite to the first end. The carbon nanotubes in the carbon nanotube structure 25 are substantially oriented from the first end to the second end. The at least two electrodes 26 are electrically connected with the first end and the second end. The carbon nanotubes in the carbon nanotube structure 25 are substantially oriented one electrode 26 to another electrode 26. A shape of the at least two electrodes 16 can be a square, a rectangle, linear, or round. The at least two electrodes 16 are located apart from each other.

Figure 6:
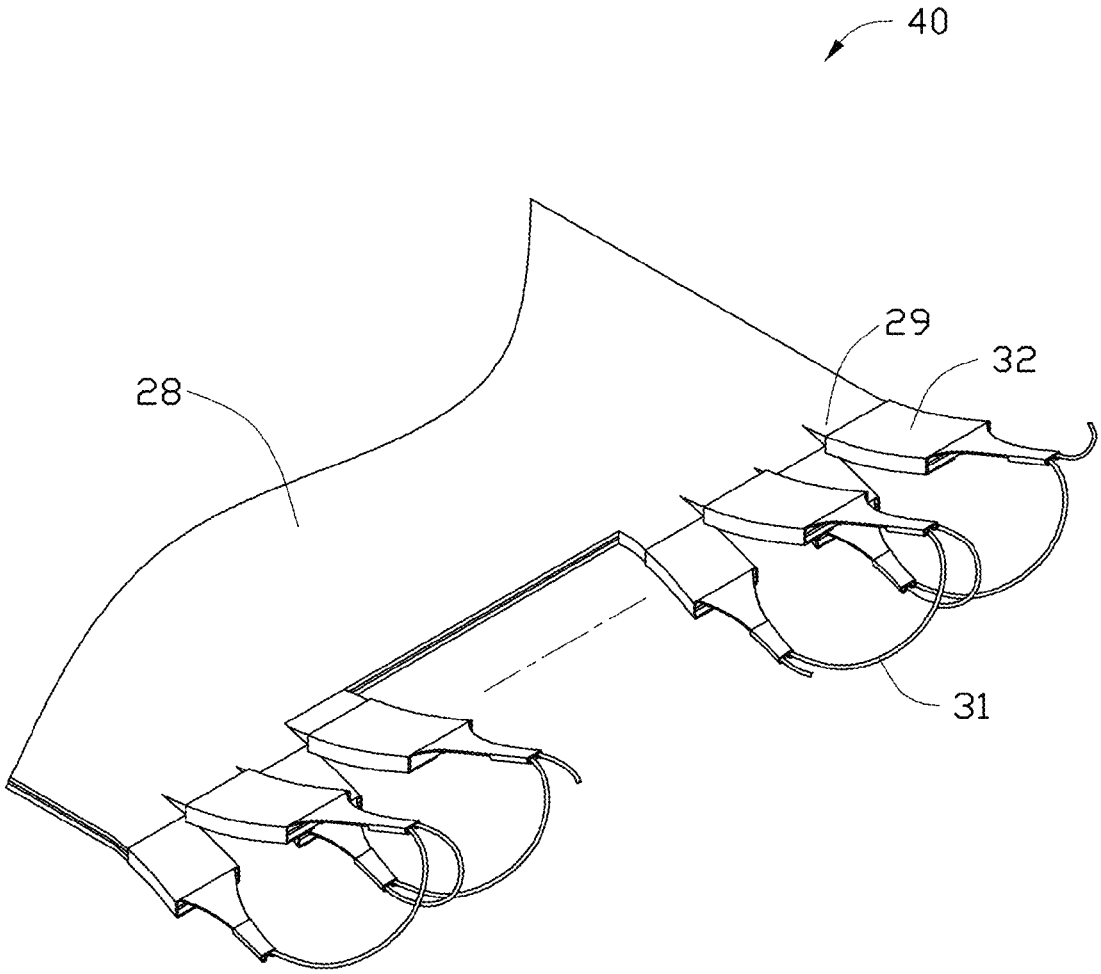
FIG. 6 is a schematic view of one embodiment of the heater.

In another embodiment, referring to FIG. 6, step N6 includes sub-steps of:

N61: cutting the first end and the second end of the carbon nanotube structure 25 and the flexible substrate 21 connected with the first end and the second end to form a plurality of linear structures 29;

N62: providing a plurality of electrodes 32, and each of the plurality of electrodes 32 clips one linear structure and is used as an electrode.

In step N61, each of the linear structures has a width of about 7 millimeters, and a length of about 10 millimeters.

In step N62, in one embodiment, the electrodes 32 have a structure that look like clamps. One linear structure is inserted into the electrode 32 and clipped by the electrode 32. Each of the electrodes 32 adjacent to the first end is electrically connected with a lead 31. A material of the plurality of electrode 32 is conductive. In one embodiment, a resistance between one clamp 32 and the linear structure is about 0.1Ω.

Characteristics of step N7 are the same as the step S5 disclosed above.

Finally, it is to be understood that the above-described embodiments are intended to illustrate rather than limit the present disclosure. Variations may be made to the embodiments without departing from the spirit of the present disclosure as claimed. Elements associated with any of the above embodiments are envisioned to be associated with any other embodiments. The above-described embodiments illustrate the scope of the present disclosure but do not restrict the scope of the present disclosure.

Depending on the embodiment, certain of the steps of methods described may be removed, others may be added, and the sequence of steps may be altered. The description and the claims drawn to a method may include some indication in reference to certain steps. However, the indication used is only to be viewed for identification purposes and not as a suggestion as to an order for the steps.

What is claimed is:

1. A method for making a heater, the method comprising:

N1: providing a support and stretching a flexible substrate along a first direction and fixing the flexible substrate on a surface of the support;

N2: coating an adhesive layer on a surface of the flexible substrate;

N3: drawing a carbon nanotube film from a carbon nanotube array, and attaching one end of the carbon nanotube film on the flexible substrate via the adhesive layer;

N4: wrapping the carbon nanotube film around the support by rotating the support to form a carbon nanotube structure around the flexible substrate and the adhesive layer;

N5: separating the flexible substrate from the support, wherein the flexible substrate shrinks along the first direction, wherein the carbon nanotube structure comprises a plurality of carbon nanotubes aligned in the first direction;

N6: electrically connecting at least two electrodes on a surface of the carbon nanotube structure; and N7: applying a voltage between the at least two electrodes to heat the carbon nanotube structure, wherein the carbon nanotube structure heats and solidifies the adhesive layer.

2. The method of claim 1, wherein step N1 comprises sub-steps of:

stretching the flexible substrate;

fixing one end of the flexible substrate on the surface of the support; and rotating the support to wrap the flexible substrate on the support.

3. The method of claim 2, wherein the flexible substrate comprises a first side and a second side, the first side of the flexible substrate is stretched and the second side is attached on the surface of the support, and the flexible substrate is wrapped around the support.

4. The method of claim 1, wherein a material of the adhesive layer is selected from the group consisting of epoxy resin, polyurethane resin, acrylates, chloroprene rubber, and silica gel.

5. The method of claim 1, wherein the step N3 comprises sub-steps of:

providing the carbon nanotube array formed on a grown substrate;

pulling out the carbon nanotube film from the carbon nanotube array; and attaching one end of the carbon nanotube film on the flexible substrate, wherein the carbon nanotube film is kept stretched between the carbon nanotube array and the flexible substrate.

6. The method of claim 5, wherein the carbon nanotube array comprises carbon nanotubes aligned in a same direction, and the aligned direction of the carbon nanotubes in the carbon nanotube array is substantially perpendicular with the substrate.

7. The method of claim 5, wherein the carbon nanotube film is pulled out by the steps of:

selecting some carbon nanotubes having a predetermined width from the array of carbon nanotubes; and pulling the carbon nanotubes to obtain nanotube segments at uniform speed to achieve the carbon nanotube film.

8. The method of claim 5, wherein when attaching one end of the carbon nanotube film on the flexible substrate, the carbon nanotube film is suspended between the carbon nanotube array and the flexible substrate.

9. The method of claim 5, wherein after the end of the carbon nanotube film is attached on the flexible substrate, an angle defined by a surface of the carbon nanotube film and the aligned direction of the carbon nanotubes in the carbon nanotube array is in a range from about 60 degrees to about 90 degrees.

10. The method of claim 1, wherein in step N4, the support rotates around its axis, and the carbon nanotube film is pulled out continuously from the carbon nanotube array and wraps around the support continuously.

11. The method of claim 10, wherein a rotating speed of the support is less than 15 m/s.

12. The method of claim 1, wherein in step N4, a pressing force is applied on the carbon nanotube structure to fill the adhesive layer into the carbon nanotube structure.

13. The method of claim 1, wherein in step N5, the flexible substrate, the adhesive layer, and the carbon nanotube structure are cut along a line which is substantially parallel with the axis of the support.

14. The method of claim 13, wherein the flexible substrate and the carbon nanotube structure are cut by a mechanical method or by an etching method.

15. The method of claim 1, wherein in step N5, the carbon nanotube structure shrinks along the first direction with the flexible substrate, and a plurality of wrinkles are formed in the carbon nanotube structure.

16. The method of claim 15, wherein each of the plurality of wrinkles has a linear structure and is oriented along a second direction, and the second direction is substantially perpendicular with the first direction.

17. The method of claim 1, wherein in step N7, the carbon nanotube structure generates Joule heat under the voltage between the at least two electrodes.

18. The method of claim 1, wherein the carbon nanotube structure comprises a plurality of carbon nanotubes joined end to end and oriented substantially along a same direction.

* * * * *